US005365612A

United States Patent [19]

Yoshida

[11] Patent Number: 5,365,612

[45] Date of Patent: Nov. 22, 1994

[54] DISPOSABLE RAIN SHIELD

[76] Inventor: Toshiyoshi Yoshida, 11-5-205 1-chome, Akabaneminami Kitaku, Tokyo, Japan

[21] Appl. No.: 21,156

[22] Filed: Feb. 22, 1993

[51] Int. Cl.[5] ..... A42B 1/20

[52] U.S. Cl. ..... 2/171; 2/175.1; 2/200.1; 2/DIG. 10

[58] Field of Search ..... 2/171, 173.5, 175, 177, 2/192, 195, 200, DIG. 3, DIG. 10, 200.1, 200.2, 175.1, 195.1

[56] References Cited

U.S. PATENT DOCUMENTS

| | | | |
|---|---|---|---|
| 606,982 | 7/1898 | Smyth | 2/171 |
| 2,673,349 | 3/1954 | Key | 2/175 |
| 2,684,483 | 7/1954 | Kwake | 2/177 |
| 2,803,015 | 8/1957 | Milone | 2/195 |

FOREIGN PATENT DOCUMENTS

| | | | |
|---|---|---|---|
| 1246269 | 10/1960 | France | 2/177 |
| 8910707 | 11/1989 | WIPO | 2/177 |

OTHER PUBLICATIONS

*Popular Science,* Nov. 1951, p. 153.

*Primary Examiner*—Clifford D. Crowder
*Assistant Examiner*—Diana L. Biefeld
*Attorney, Agent, or Firm*—David O'Reilly

[57] ABSTRACT

A disposable rain shield consisting of a bag having a looped shape and a perpheral inflatable bag. A chin strap is attached to central part of the bag and a valve is provided on the bag for injecting air into the bag.

1 Claim, 1 Drawing Sheet

DISPOSABLE RAIN SHIELD

FIELD OF THE INVENTION

This invention relates to a disposable rain shield.

1. Background of the Invention

Heretofore, there is a disposable rain shield consisting of a water proof sheet having a chin strap.

However, they were not rigid, are hard to use because the sheet sticks to face, and are insufficient to protect the lower part of a user from the rain.

2. Brief Description of the Invention

Therefore, an object of this invention is to provide a disposable rain shield consisting of bag A of a looped shape, a chin strap B attached to a central part D of the bag A and a valve C provided on the bag A for injecting air into the Bag A.

Another object of this invention is to provide a disposable rain shield which is possible to fold in an unused state, and which is used by injecting air through valve C to expand bag A then the central part D is put on the head, and the chin strap is wound on the jaw of the user and the strap is tied.

The above and other objects, advantages and novel features of this invention will be more fully understood from the following detailed description and the accompanying drawings.

The above and other features of this invention will be fully understood from the following detailed description and the accompanying drawings, in which:

DETAILED DESCRIPTION OF THE INVENTION

Figure 1:
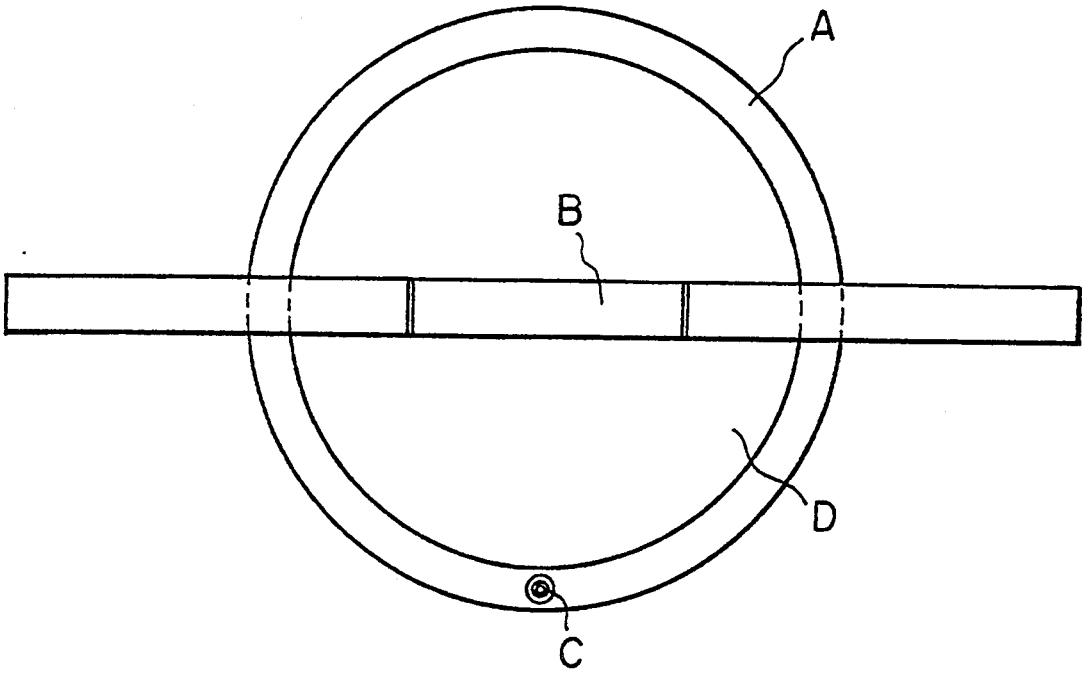
FIG. 1 is a bottom view of this invention.

FIG. 1 is a bottom view of the invention of a disposable rain shield consisting of bag A of looped shape. Chin strap B is attached to a central part D of bag A and a valve C provides for injecting air into the bag A.

Figure 2:
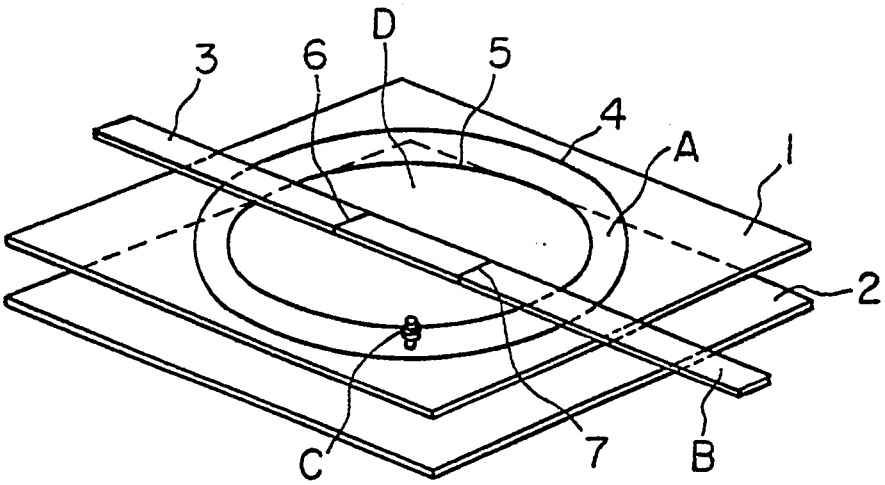
FIG. 2 is a perspective view showing the steps for manufacturing this invention.

FIG. 2 is a perspective view showing the manufacturing steps of the embodiment of this invention. Upper sheet 1 and lower sheet 2 of hot melt thermoplastic resin are superimposed and tape 3 of the same material is positioned on central part D, to seal them along heat sealing double circle lines 4, 5. Short heat sealing lines 6, 7 are spaced a distance corresponding to the width of a human head. Thereby, the part between heat sealing lines 4, 5 provides bag A in a looped shape and tape 3 sealed to central part D provides chin strap B. Then a check valve C is provided on the bag A. The outer parts of sheet 1 and 2 outside heat sealing line 4 are removed.

The diameter of bag A is about 900 to 1000 mm for a adult and 800 mm for child. An advertisement can be printed on sheets 1, 2 if desired.

As explained above, the invention is very simple and it is possible to provide it at a cheap price so it may be disposable. Inflatable bag A provides some rigidity to the body so that it does not stick to the face of a user and protects the lower part of a user from rain.

This invention is not to be limited by the embodiment shown in the drawings and described in the description which is given by way of example and not of limitation, but only in accordance with the scope of the appended claims.

What is claimed is:

1. A method of forming a disposable rain shield comprising; superimposing a pair of rectangular plastic sheets in alignment one on top of the other; disposing an elongate plastic strap across and through the center of said superimposed plastic sheets, said elongate plastic strap extending beyond the edges of said pair of rectangular superimposed plastic sheets a predetermined amount; heating said pair of superimposed plastic sheets to produce a pair of bonded concentric circles to form an air chamber; simultaneously heating a pair of strips of said elongate plastic strap inside said pair of bonded concentric circles to bond said elongate plastic strap to said superimposed rectangular plastic sheets in two places; trimming off excess material of said pair of superimposed rectangular plastic sheets outside said pair of bonded concentric circles forming said air chamber; sealing an air valve in said air chamber when said pair of bonded concentric circles are formed; whereby a simple very inexpensive disposable rain shield is formed.

* * * * *